US007461418B2

(12) United States Patent
Vlahos et al.

(10) Patent No.: US 7,461,418 B2
(45) Date of Patent: Dec. 9, 2008

(54) SYSTEM FOR ENCOURAGING GOOD PERSONAL HYGIENE IN TOILET FACILITIES

(75) Inventors: Gustav Vlahos, Westchester, IL (US); Robert B. Jones, River Forest, IL (US)

(73) Assignee: Vlahos Enterprises, River Forest, IL (US)

( * ) Notice: Subject to any disclaimer, the term of this patent is extended or adjusted under 35 U.S.C. 154(b) by 489 days.

(21) Appl. No.: 11/358,551

(22) Filed: Feb. 21, 2006

(65) Prior Publication Data

US 2006/0191068 A1 Aug. 31, 2006

Related U.S. Application Data

(60) Provisional application No. 60/656,491, filed on Feb. 25, 2005.

(51) Int. Cl.
*A47K 17/00* (2006.01)

(52) U.S. Cl. ..... 4/661; 4/314; 340/573.1

(58) Field of Classification Search ..... 4/300–305, 4/314, 661, 902; 340/573.1; 434/262
See application file for complete search history.

(56) References Cited

U.S. PATENT DOCUMENTS

| | | | | |
|---|---|---|---|---|
| 5,573,407 | A * | 11/1996 | Dunford | 434/262 |
| 5,870,015 | A | 2/1999 | Hinkel | |
| 5,952,924 | A * | 9/1999 | Evans et al. | 340/573.1 |
| 6,028,520 | A | 2/2000 | Maehre | |
| 6,037,871 | A * | 3/2000 | Babylon | 340/573.1 |
| 6,038,711 | A | 3/2000 | Clarke | |
| 6,282,732 | B1 | 9/2001 | Krvavica et al. | |
| 6,417,773 | B1 | 7/2002 | Vlahos et al. | |
| 2004/0155779 | A1 * | 8/2004 | Ballard | 340/573.1 |

* cited by examiner

*Primary Examiner*—Charles E Phillips
(74) *Attorney, Agent, or Firm*—Fitch, Even, Tabin & Flannery

(57) ABSTRACT

A system encouraging users to cleanse their hands after use of a tankless toilet having a flush valve controlling the flow of water into a toilet bowl through a conduit, in which an abrupt temperature change in the conduit is used to trigger a recorded message urging the user to wash his or her hands.

6 Claims, 2 Drawing Sheets

SYSTEM FOR ENCOURAGING GOOD PERSONAL HYGIENE IN TOILET FACILITIES

CROSS REFERENCE TO RELATED APPLICATION

This application claims benefit of U.S. Provisional Patent Application No. 60/656,491, filed Feb. 25, 2005, which is hereby incorporated by reference in its entirety.

BACKGROUND OF THE INVENTION

The present invention relates generally to systems for improving sanitation in toilet facilities and, more particularly, for encouraging good personal hygiene by users of toilet facilities.

In our prior U.S. Pat. No. 6,417,773, which is hereby incorporated by reference in its entirety, we noted that a pervasive cause of gastrointestinal illness is contamination of food by fecal microorganisms. A major source of such contamination is inadequate cleansing of the hands by food preparation personnel after the use of toilet facilities. Public health authorities regularly encourage institutional food service providers to admonish their employees to adhere to accepted sanitation procedures. In particular, food handlers are expected to thoroughly cleanse their hands after using the toilet. To achieve that end, training sessions and warning signs are used to educate employees about the dangers of inadequate cleansing, and to instill in them the habit of careful hand washing.

Similarly, children must be educated in the necessity of washing their hands to avoid the spread of gastrointestinal illness in the family. Having succeeded in toilet training their children, parents are then faced with the challenge of further educating them in personal cleanliness, something of which many children are blissfully unaware. No matter how frequently children are cautioned about hand washing, they are often over-anxious to return to their play and, forgetting about their parents' admonitions, rush to resume their activities, sans ablutions.

Outbreaks of viral illnesses have accentuated the need for good hygiene. For example, the SARS virus may be transmitted from person to person by touching contaminated surfaces, as may a host of other viruses. If the hands are not thoroughly cleansed after coming in contact with such a surface, the virus finds access to the body when fingers are put to the mouth or nose.

Solutions to these problems have been proposed, with marginal success. For example, U.S. Pat. No. 6,028,520 recites as one object to train children to wash their hands after using the toilet, accomplished by providing an annunciator triggered by a motion detector or a switch actuated by the toilet flush lever, whereupon a suitable recorded message is played admonishing the child to wash his or her hands. Such triggering means are less than satisfactory. In the case of a motion sensor, the annunciator is activated by motion not associated with toilet use, resulting in needless repetition of the message, and loss of its effectiveness. In the case of a lever-actuated switch, the switch must be coupled to the lever, requiring undesired mechanical modification of the toilet.

Our '773 patent provided an elegant solution to these problems. In accordance with the '773 patent, a recorded message is activated by the sound generated by the flow of water into the toilet bowl when the toilet is flushed. The system comprises a microphone positioned so as to intercept the sound generated by the flushing toilet, an amplifier, a controller, a voice chip or other audio storage means, and a speaker.

Although the system of the '773 patent provides an innovative solution to the foregoing problems, it requires sophisticated sound detection and recognition circuitry, capable of greater than 90% sound recognition and greater than 90% rejection of noise. Noise rejection is particularly important because false triggering greatly diminishes the effectiveness of the message. Noise rejection is complicated by the different acoustics of institutional restrooms and unpredictable background signals.

It is, therefore, the principal object of the present invention to provide a simplified apparatus and method for detecting the flushing of a toilet, particularly an institutional tankless toilet, to trigger an announcement urging a toilet user to wash his or her hands.

SUMMARY OF THE INVENTION

In accordance with the present invention, there is provided a system for encouraging the practice of good hygiene, wherein after use of a toilet the user is reminded by a recorded message to thoroughly cleanse his or her hands before leaving. The system is particularly adapted for use in institutional restrooms having tankless toilets, where water is directly admitted from a water supply line into the toilet bowl.

Very generally, in accordance with the present invention, a recorded message is triggered by a surface temperature change of the conduit between the flush valve of a tankless toilet and the toilet bowl. That conduit is normally empty and, when empty, its surface temperature comes to equilibrium at or near the ambient room temperature. When the flush valve is opened, however, flush water flows into the conduit, and the surface temperature of the conduit rapidly changes and approaches the temperature of the water supply.

Further in accordance with the present invention, a temperature sensor provides an output signal indicative of the surface temperature of the conduit. The sensor is interrogated at successive predetermined intervals. Means are provided for comparing the output signal of the sensor at the beginning of one interval with the same signal at the beginning of a succeeding interval, and if an abrupt change in temperature occurs, another signal is generated which triggers a recorded message urging the toilet user to wash his or her hands.

BRIEF DESCRIPTION OF THE DRAWING

Various objects and advantages of the present invention will be apparent upon consideration of the following detailed description, taken in conjunction with the accompanying drawing, in which.

DETAILED DESCRIPTION OF THE INVENTION

Figure 1:
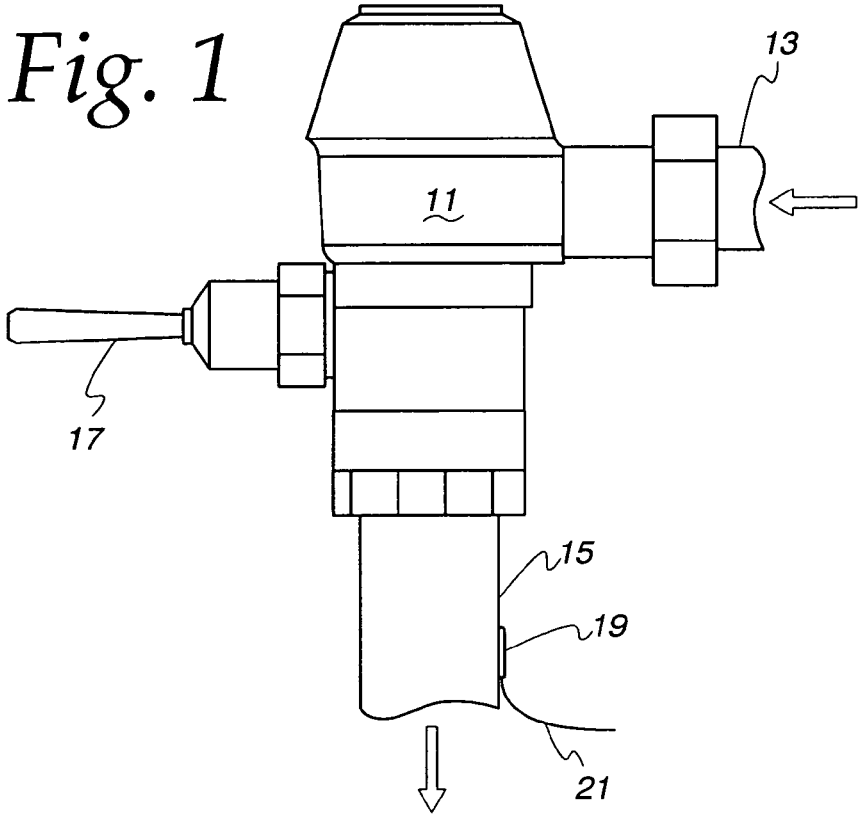
FIG. 1 is a fragmentary front view of a typical flush valve for a tankless toilet, with an inlet conduit and an outlet or discharge conduit.

In accordance with the present invention, and with reference to the drawing, FIG. 1 shows a flush valve 11 for a tankless toilet (not shown), in fluid communication with an inlet conduit 13 and an outlet conduit 15. The inlet conduit 13 is provided with water from a water supply system, which, when the flush valve 11 is opened, permits flow of water into the valve through the inlet conduit 13, and out of the valve into the toilet through the outlet conduit 15.

The outlet conduit 15 is normally empty except during the period when the flush valve 11 is open to permit water to flow through the outlet conduit 15 in the direction of the arrow in FIG. 1. The flush valve 11 comprises a valve handle 17 operatively connected to a diaphragm (not illustrated) inside the valve body, which causes the valve to open, thereby admitting an inrush of water through the valve and into the toilet bowl. A typical flush valve is that sold by Sloan Valve Company under the trademark "ROYAL".

Also illustrated in FIG. 1 is a temperature sensor 19 in conductive contact with the outside wall of the discharge conduit 15. The temperature sensor may be a thermocouple or, more desirably, a resistance temperature detector, both of which are well known to persons of ordinary skill. Electrical leads 21 connect the temperature sensor 19 to the temperature detector/transmitter, soon to be described.

Figure 2:
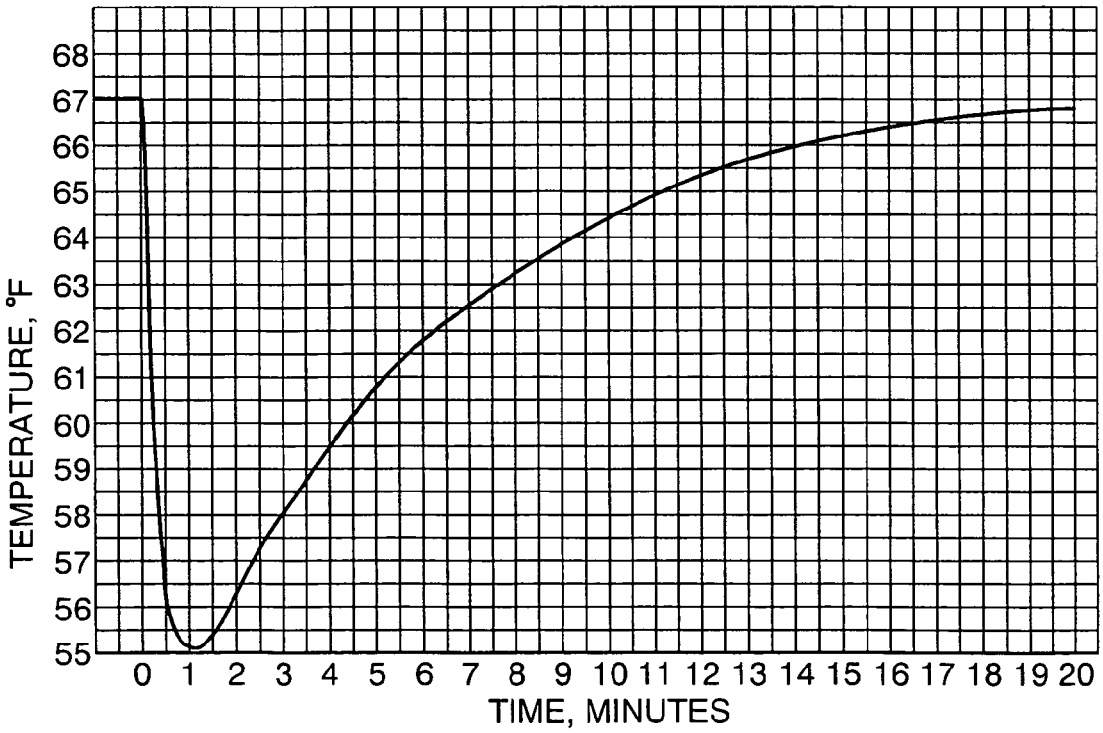
FIG. 2 is a graph depicting the surface temperature of the outlet conduit of FIG. 1 before, during, and after the flush valve is opened.

FIG. 2 depicts a typical plot of the wall temperature of the outlet conduit 15 before, during, and after the flush valve 11 is opened. It will be seen that in a steady state condition (before the flush valve is opened) the wall temperature of the discharge conduit is substantially constant at 67° F., intermediate ambient room temperature and the temperature of the inlet conduit 13.

In the graph of FIG. 2, the flush valve 11 is opened at time zero. Immediately after opening, the surface temperature of the outlet conduit 15 abruptly drops to approach the temperature of water entering the inlet conduit 13, in this case slightly more than 55° F.

The elapsed time between opening of the flush valve and the time when the surface temperature of the outlet conduit 15 reaches its minimum is about 1 minute. The time and the minimum temperature achieved are dependent on the length of time that the flush valve 11 remains open as well as on the temperature of the water entering the inlet conduit 13.

When the flush valve 11 closes, the surface temperature of the outlet conduit 15 gradually begins to rise, asymptotically approaching the steady state temperature of 67° F.

It will be seen that, in the usual condition when the temperature of the water supplied to the flush valve 11 is lower than the ambient temperature of the toilet facility, the only occasion when the surface temperature of the outlet conduit 15 decreases is immediately after the flush valve is opened.

In accordance with the present invention, and in its broader aspect, an abrupt decrease in the surface temperature of the outlet conduit 15 is used to trigger a pre-recorded message urging the toilet user to wash his or her hands. The message is generated by a voice chip and speaker as illustrated diagrammatically in our U.S. Pat. No. 6,417,773.

Figure 3:
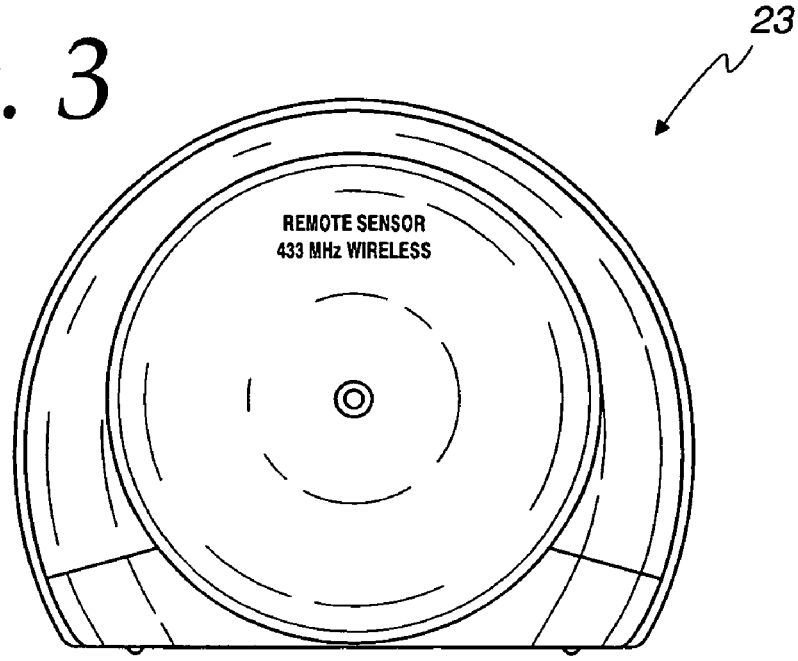
FIG. 3 is a depiction of a commercially-available detector/transmitter of a wireless temperature indicating system.
Figure 4:
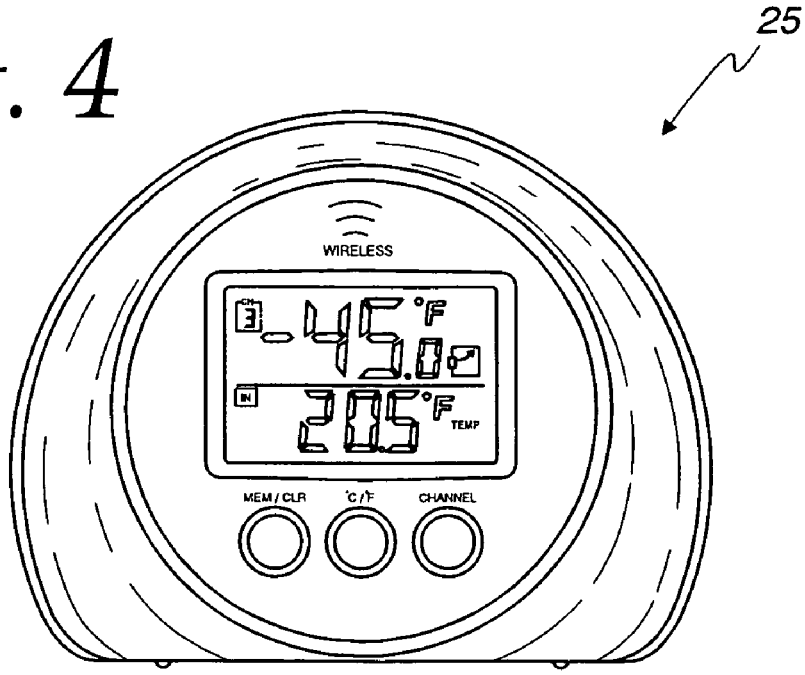
FIG. 4 is a depiction of a commercially-available receiver/processor of the wireless temperature indicating system of FIG. 3.

FIGS. 3 and 4 depict a detector/transmitter 23 and a receiver/processor 25 which may be utilized in the practice of the present invention. A preferred system for accomplishing the objects of the present invention is a system available from Springfield Precision Instruments, Inc., 76 Passaic Street, Wood-Ridge, N.J.

The detector/transmitter 23 converts the signal from the temperature sensor 19 to an electrical signal transmitted to the receiver/processor 25. The receiver/processor is responsive to any decrease in temperature of the surface of the outlet conduit 15, and utilizes it to trigger the desired pre-recorded message.

It should be understood that although the commercial embodiment of the system available from Springfield Precision Instruments displays the temperature of the temperature sensor 19 on the detector/transmitter 23 or the receiver/processor 25, or on both, that temperature need not be displayed at all in accordance with the teachings of the present invention. It is only necessary that the system detect a change in temperature.

Although as shown in FIG. 2, the only occasion in which the surface temperature of the outlet conduit 15 decreases is upon flushing of the toilet, it is possible that it can decrease on other occasions as well. If the toilet is not flushed for an extended period of time, and if the ambient temperature in the toilet facility decreases (albeit slowly), false triggering of the announcement could occur. To avoid such false triggering, and in another embodiment of the present invention, the system may be modified so that only an abrupt decrease in the temperature of the outlet conduit 15 will produce an announcement. If, for example, the temperature of the outlet conduit 15 is sampled every thirty seconds, a decrease in temperature of at least about 0.2° F. in successive samplings may be used to trigger the announcement.

In another embodiment of the present invention, in which the temperature of the water supplied to the flush valve 11 is higher than the ambient temperature in the toilet facility, the wall temperature of the outlet conduit will increase, rather than decrease when the flush valve is opened. This will mostly occur in non-temperate geographical regions, particularly if the toilet facility is air-conditioned.

Under such circumstances, the system is modified so that the recorded announcement is triggered by an abrupt increase in the wall temperature of the outlet conduit, i.e., an increase of at least about 0.2° F. in successive samplings.

Under rare circumstances, the temperature of the water supplied to the flush valve 11 will be substantially the same as the ambient temperature in the toilet facility, i.e., within 0.2° F. of the latter temperature. It is apparent that the announcement will not be triggered under these circumstances.

The foregoing description is not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

What is claimed is:

1. A system encouraging users to cleanse their hands after use of a tankless toilet having a flush valve controlling the flow of water through a conduit into the toilet bowl, comprising:

a sensor detecting the temperature of the conduit wall;

means for interrogating said sensor at selected intervals;

means for comparing the conduit wall temperature at the beginning of an interval with that at a succeeding interval;

means detecting the rate of change of the conduit wall temperature; and means triggering a recorded announcement urging the toilet user to wash his or her hands upon detection of a preselected rate of change of the conduit wall temperature.

2. The system of claim 1 wherein the conduit wall temperature decreases upon opening of the flush valve.

3. The system of claim 1 wherein the conduit wall temperature increases upon opening of the flush valve.

4. The system of claim 1 wherein the preselected rate of change of the conduit wall temperature is at least about 0.2° F. in 30 seconds.

5. A method of encouraging toilet users to wash their hands after flushing a tankless toilet having a flushing means for controlling flow of water through a conduit into the toilet bowl comprising:

sensing a temperature of the wall of the conduit downstream of the flushing means at preselected intervals of time;

detecting the rate of change of said temperature between said intervals; and triggering a recorded announcement urging the user to wash his or her hands when the detected rate of change of said temperature is greater than a preselected value.

6. The method of claim 5 wherein said preselected value is at least about 0.2° F. in 30 seconds.

* * * * *